US006334451B1

(12) United States Patent
Yang

(10) Patent No.: US 6,334,451 B1
(45) Date of Patent: Jan. 1, 2002

(54) TOOTHBRUSH WITH FILLING OF TOOTHPASTE

(76) Inventor: Ching-yuan Yang, Fifth Floor, 131-20 Keelung Road Section 2, Taipei (TW), 110

( * ) Notice: Subject to any disclaimer, the term of this patent is extended or adjusted under 35 U.S.C. 154(b) by 0 days.

(21) Appl. No.: 09/692,399

(22) Filed: Oct. 19, 2000

(51) Int. Cl.[7] ..... A46B 11/00
(52) U.S. Cl. ..... 132/311
(58) Field of Search ..... 132/311, 308; 401/174, 175

(56) References Cited

U.S. PATENT DOCUMENTS 965,309 A * 7/1910 MacDonald ..... 132/311
1,340,043 A * 5/1920 Grace ..... 132/311
1,451,941 A * 4/1923 Clum ..... 401/175
1,711,183 A * 4/1929 Smith ..... 132/311
3,728,035 A * 4/1973 Reitnecht ..... 401/175
4,655,627 A * 4/1987 Bradley ..... 401/175
5,026,191 A * 6/1991 Akly ..... 401/175
5,100,252 A * 3/1992 Podolsky ..... 401/175
5,913,632 A * 6/1999 Pesad ..... 401/175
5,918,996 A * 7/1999 Coolbaugh ..... 401/175

* cited by examiner

*Primary Examiner*—Todd E. Manahan

(57) ABSTRACT

A toothbrush with filling of toothpaste basically comprises a cylindrical toothpaste receiver having toothpaste therein, a toothbrush head with a guide passage therein, a turning end cap with a threaded rod and a squeezing block attaching to the threaded rod. When the end cap is turned, the squeezing block may be actuated to move forward or backward such that the toothpaste may be squeezed toward the toothbrush head to overflow over the bristles through the guide passage.

3 Claims, 2 Drawing Sheets

TOOTHBRUSH WITH FILLING OF TOOTHPASTE

BACKGROUND OF THE INVENTION

1. Field of the Invention

The present invention relates to a toothbrush with filling of toothpaste, and particularly to an improvement on a toothbrush with filling of toothpaste.

2. Description of Related Art

In this highly industrialized society, we often have chance to stay out for business or traveling and toilet set, which contains a least a toothbrush, a toothpaste, a towel, and a soap, usually is an essential part of personal belongings being carried with. However, sometimes, one or two items in the toilet set may be forgot to prepare and, for instance, the toothbrush has been prepared but the toothpaste has been carelessly forgotten. Hence, the teeth are brushed roughly or tumbled with water instead. As a result, the personal hygiene and the body health are affected unconsciously. Even more, the foul breath may result in rough manners to others unintentionally. The simply packed hygienic toothbrush in the hotel usually provides poor quality such that bristles on the toothbrush may sting the mouth or Fall off during brushing. Even if the toothbrush provided by the hotel is expensively made with better quality, it Is wasteful because usually the toothbrush in the hotel is discarded after using once. If the toothbrush is going to be used for second time or third time, the toothpaste offered by the hotel has been run out. Besides, our contemporaries pay more attention to the hygiene than before and a lot of people are used to brushing teeth more than once a day such that it is quite inconvenient to carry with the toothbrush and the toothpaste every morning while we are going out for work. Moreover, we also have had an experience with regard to the teeth being forgotten to brush or being unable to brush in time while we are going out in the morning. Therefore, an easily portable toothbrush containing the toothpaste being developed may solve the problem of the toothbrush and the toothpaste being carried separately and it is a great contribution for the daily life of everybody.

SUMMARY OF THE INVENTION

A toothbrush with filling of toothpaste according to the present invention basically comprises a cylindrical toothpaste receiver having toothpaste therein, a brush head with a guide hole therein, a turning end cap with a threaded rod and a squeezing block attached to the threaded rod. When the end cap is turned, the squeezing block may be actuated to move forward or backward such that the toothpaste may be squeezed toward the brush head to overflow over the brush bristles through the guide hole.

An object of the present invention is to provide a toothbrush with filling of toothpaste, which has a handle containing toothpaste to conform to the squeezing part therein. Therefore, the brush head is possible to obtain a proper amount of toothpaste while the toothpaste is pushed by the squeezing part to move spirally forward.

Another object of the present invention is to provide a toothbrush with filling of toothpaste, which offers an easily portable toothbrush without the need of carrying the toothpaste individually.

BRIEF DESCRIPTION OF THE DRAWINGS

The major feature and the novelty of the present invention can be more fully understood by referring to the following description and accompanying drawings, in which.

DETAILED DESCRIPTION OF THE PREFERRED EMBODIMENT

Figure 1:
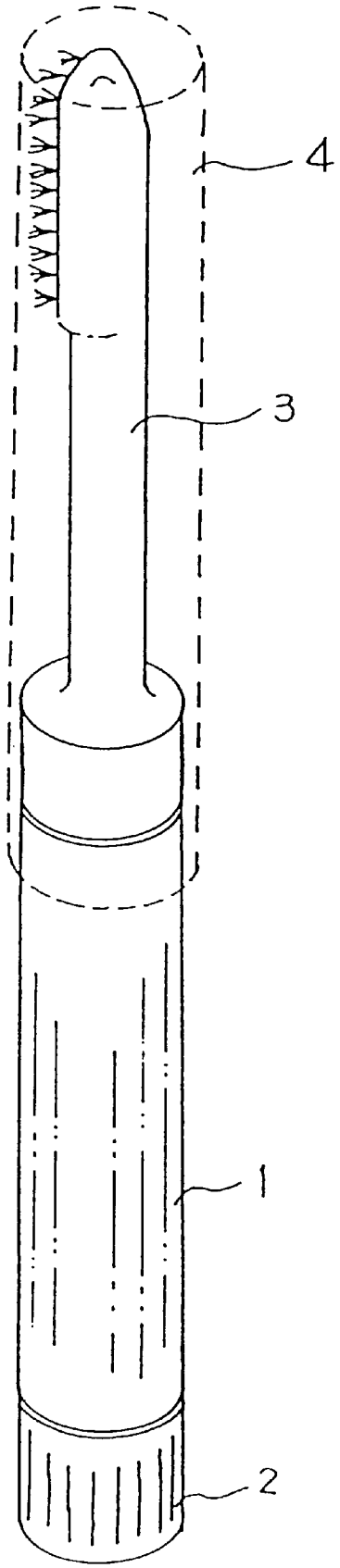
FIG. 1 is a perspective view of a toothbrush with filling of toothpaste according to the present invention.
Figure 2:
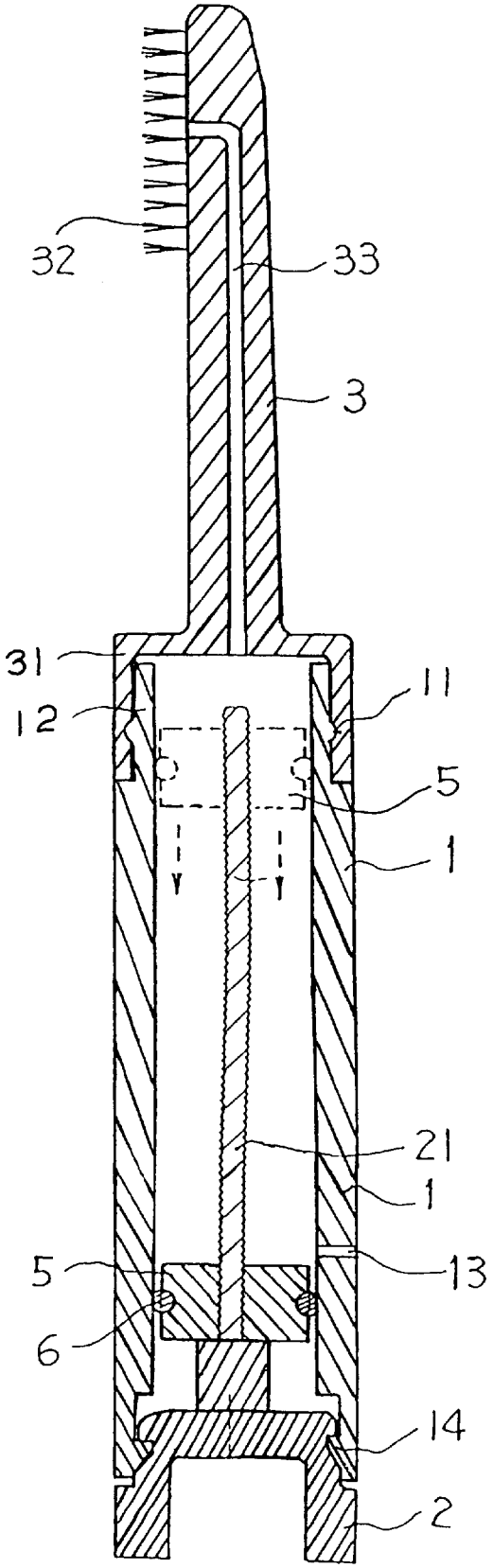
FIG. 2 is a sectional view of the toothbrush shown in FIG. 1.
Figure 3:
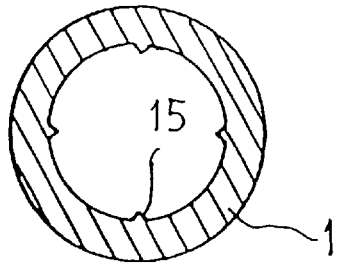
FIG. 3 is a cross section view of a toothpaste receiver used in the present invention.

Referring to FIGS. 1, 2, and 3, the toothbrush with filling of toothpaste according the present invention mainly has a cylindrical toothpaste receiver 1 (i.e. the handle of toothbrush). The toothpaste receiver 1 at the front end thereof is provided with a fitting neck 12 for fitting with a toothbrush head 3. An engaging outer ring 11 is provided on the fitting neck 12 to engage with an inner annular recession in a fitting end 31 of the toothbrush head 3 such that the toothpaste receiver 1 can fit with the toothbrush head 3. It is noted that a plurality of projecting spots can be provided instead of the engaging ring 11. A longitudinal guide passage 33 is provided in the toothbrush head 3 and extends from the fitting end 31 to a bristle part 32 such that the squeezed toothpaste may move to he bristle part 32 along the guide passage 33. A protect lid 4 is used for covering the toothbrush head 3. The rear end of the toothpaste receiver 1 is provided with an inverted hook ring 14 and a turning end cap 2 has an outer annular recession corresponding to the hook ring 14. When the turning end cap 2 is inserted into the rear end of the toothpaste receiver, the inverted hook ring 14 engages with the outer annular recession to form a rotatably permanent engagement without being detached any more. Hence, a plurality of air apertures 13 are provided at the lower portion of the toothpaste receiver 1 right over the rearmost position of the squeezing block 5. The air apertures 13 may discharge the air in the toothpaste receiver 1 for the toothpaste being filled into the receiver 1, otherwise, it is hard to fill with the toothpaste completely. A threaded rod 21 is fixedly attached to the inner side of the cap 2 at the center thereof and a squeezing block 5 is movably attached to the threaded rod 21. The squeezing block 5 has an annular groove 51 surrounding the periphery thereof to receive a resilient seal ring 6. In order to allow the squeezing block 5 not being turned along wish the threaded rod 21, a plurality of small longitudinal projecting ribs 15 are integrally attached to the inner wall of the toothpaste receiver 1 to increase the friction force generated. Accordingly, the turning end cap 2 is rotated lightly nay make the squeezing block 6 push the toothpaste therein toward the guide hole 33 in the toothbrush head 3. Then, the toothpaste may move to the bristle part 32 via the guide passage 33 so as to be used while the teeth are brushed. Once the toothpaste is filled, detach the toothbrush head 3 and retreat the squeezing block 5 to the rear end of the toothpaste receiver 1 and a tube of toothpaste can be squeezed into the toothpaste receiver 1 from the front end thereof. Finally, the toothbrush head 3 is fitted to the toothpaste receiver 1 again as soon as a proper amount of toothpaste is filled and the squeezing block 5 is moved above the air apertures 13 to complete the refill job.

It can be understood that the present invention offers an effective combination of toothbrush and toothpaste to easily perform a function of portable self-supply. Furthermore, it is possible to obtain a proper amount of toothpaste for using and to be refilled the toothpaste. Accordingly, the present invention is durable for being conveniently used a long period of time regardless at home or out of home.

While the invention has been described with reference to a preferred embodiment thereof, it is to be understood that modifications or variations may be easily made without departing from the spirit of this invention, which is defined by the appended claims.

What is claimed is:

1. A toothbrush with filling of toothpaste, comprising:

a toothpaste receiver with a front end and a rear end, being an elongated hollow cylinder, and the front end being a fitting neck;

a toothbrush head, being a bristle part with a fitting end, having an inner guiding passage extending from the fitting cad, and the fitting end detachably fitting with the front end of the toothpaste receiver;

a turning end cap, extending outward a threaded rod to be received in the toothbrush receiver, and fitting with the rear end of the toothpaste receiver; and a squeezing block, being movably attached to the threaded rod;

characterized in that the rear end of the toothpaste receiver provides an inverted inner hook ring and the end cap provides an outer annular recession corresponding to the inverted inner hook ring such that the end cap can rotatably engage with the rear end of the toothpaste receiver permanently; the squeezing block at a periphery thereof provides a resilient soft sealing ring; an inner wall of the toothpaste receiver provides a plurality of small longitudinal projecting ribs to contact with the squeezing block; and a plurality of air apertures are disposed on the toothpaste receiver near the rear end thereof and just above a rearmost position of the squeezing block during moving backward;

whereby, the end cap can rotate with the threaded rod smoothly by way of being lightly stirred by a finger and the squeezing block can move rectilinearly along the threaded rod instead of rotating with the threaded rod due to an increased friction generated between the squeezing block and the projecting ribs.

2. The toothbrush with filling of toothpaste as defined in claim 1, wherein the fitting neck of the toothpaste receiver engages with the fitting end of the toothbrush head by way of an annular Projection ring and an annular recess ring thereon respectively.

3. The toothbrush with filling of toothpaste as defined in claim 1, wherein the threaded rod a: an end thereof is attached to a center part of the end cap.

* * * * *